US006491569B2

(12) United States Patent
Bibby, Jr. et al.

(10) Patent No.: US 6,491,569 B2
(45) Date of Patent: Dec. 10, 2002

(54) METHOD AND APPARATUS FOR USING OPTICAL REFLECTION DATA TO OBTAIN A CONTINUOUS PREDICTIVE SIGNAL DURING CMP

(75) Inventors: Thomas Frederick Allen Bibby, Jr., St. Albans, VT (US); John A. Adams, Escondido, CA (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/838,980

(22) Filed: Apr. 19, 2001

(65) Prior Publication Data

US 2002/0155788 A1 Oct. 24, 2002

(51) Int. Cl.[7] ..... B24B 49/00
(52) U.S. Cl. ..... 451/6; 451/5; 451/8
(58) Field of Search ..... 451/6, 5, 8, 41, 451/285, 286, 287, 288, 289; 156/345; 438/692

(56) References Cited

U.S. PATENT DOCUMENTS

| | | | | |
|---|---|---|---|---|
| 4,493,745 | A | 1/1985 | Chen et al. | |
| 4,615,761 | A | 10/1986 | Tada et al. | |
| 5,131,752 | A | 7/1992 | Yu et al. | |
| 5,413,941 | A | 5/1995 | Koos et al. | |
| 5,433,651 | A | 7/1995 | Lustig et al. | |
| 5,653,894 | A | 8/1997 | Ibbotson et al. | |
| 5,659,492 | A | 8/1997 | Li et al. | |
| 5,663,797 | A | 9/1997 | Sandhu | |
| 5,872,633 | A | 2/1999 | Holzapfel et al. | |
| 5,969,805 | A | 10/1999 | Johnson et al. | |
| 6,010,538 | A | 1/2000 | Sun et al. | |
| 6,028,664 | A | 2/2000 | Cheng et al. | |
| 6,028,669 | A | 2/2000 | Tzeng | |
| 6,081,334 | A | 6/2000 | Grimbergen et al. | |
| 6,106,662 | A | 8/2000 | Bibby, Jr. et al. | |
| 6,153,116 | A | 11/2000 | Yang et al. | |
| 6,160,621 | A | 12/2000 | Perry et al. | |
| 6,276,987 | B1 * | 8/2001 | Li et al. | 451/5 |
| 6,296,548 | B1 * | 10/2001 | Wiswesser et al. | 451/8 |
| 6,334,807 | B1 * | 1/2002 | Lebel et al. | 451/6 |

FOREIGN PATENT DOCUMENTS

| | | |
|---|---|---|
| EP | 0 738 561 A1 | 10/1996 |
| EP | 0 824 995 A1 | 2/1998 |
| WO | WO 98/05066 | 2/1998 |

* cited by examiner

*Primary Examiner*—Timothy V. Eley
*Assistant Examiner*—Dung Van Nguyen
(74) *Attorney, Agent, or Firm*—Snell & Wilmer, L.L.P.

(57) ABSTRACT

A method and apparatus to generate an endpoint signal to control the polishing of thin films on a semiconductor wafer surface includes a through-bore in a polish pad assembly, a light source, a fiber optic cable, a light sensor, and a computer. The light source provides light within a predetermined bandwidth, the fiber optic cable propagates the light through the through-bore opening to illuminate the surface as the pad assembly orbits, and the light sensor receives reflected light from the surface through the fiber optic cable and generates reflected spectral data. The computer receives the reflected spectral data and calculates an endpoint signal by comparing the reflected spectral data with previously collected reference data. The comparison involves calculating an evaluation time based on the comparison, and calculating a difference time utilizing correlation to account for over polish/under polish. The endpoint is predicted utilizing the evaluation time and the difference time.

16 Claims, 5 Drawing Sheets

METHOD AND APPARATUS FOR USING OPTICAL REFLECTION DATA TO OBTAIN A CONTINUOUS PREDICTIVE SIGNAL DURING CMP

FIELD OF THE INVENTION

The present invention relates to chemical mechanical planarization CMP), and more particularly, to optical endpoint detection during a CMP process, and specifically to prediction of that endpoint.

BACKGROUND

Chemical mechanical planarization (CMP) has emerged as a crucial semiconductor technology, particularly for devices with critical dimensions smaller than 0.5 micron. One important aspect of CMP is endpoint detection (EPD), i.e., determining during a polishing process when to terminate the polishing process.

Many users prefer EPD systems that are "in situ EPD systems", which provide EPD during the polishing process. Numerous in situ EPD methods have been proposed, but few have been successfully demonstrated in a manufacturing environment and even fewer have proved sufficiently robust for routine production use.

One group of prior art in situ EPD techniques involves the electrical measurement of changes in the capacitance, the impedance, or the conductivity of the wafer and calculating the endpoint based on an analysis of this data. To date, these particular electrically-based approaches to EPD do not appear to be commercially viable.

Another electrical approach that has proved production worthy is to sense changes in the friction between the wafer being polished and the polish pad. Such measurements are done by sensing changes in the motor current. These systems use a global approach, i.e., the measured signal assesses the entire wafer surface. Thus, these systems do not obtain specific data about localized regions. Further, this method works best for EPD for metal CMP because of the dissimilar coefficient of friction between the polish pad and the layers of metal film stacks such as a tungsten-titanium nitride-titanium film stack versus the coefficient of friction between the polish pad and the dielectric underneath the metal. However, with advanced interconnection conductors, such as copper (Cu), the associated barrier metals, e.g., tantalum or tantalum nitride, may have a coefficient of friction that is similar to the underlying dielectric. The motor current approach relies on detecting the copper-tantalum nitride transition, then adding an overpolish time. Intrinsic process variation in the thickness and composition of the remaining film stack layer mean that the final endpoint trigger time may be less precise than is desirable.

Another group of methods uses an acoustic approach. In a first acoustic approach, an acoustic transducer generates an acoustic signal that propagates through the surface layer(s) of the wafer being polished. Some reflection occurs at the interface between the layers, and a sensor positioned to detect the reflected signals can be used to determine the thickness of the topmost layer as it is polished. In a second acoustic approach, an acoustical sensor is used to detect the acoustic signals generated during CMP. Such signals have spectral and amplitude content that evolves during the course of the polish cycle. However, to date there has been no commercially available in situ endpoint detection system using acoustic methods to determine endpoint.

Finally, the present invention falls within the group of optical EPD systems. An optical EPD system is disclosed in U.S. Pat. No. 5,433,651 to Lustig et al. in which light transmitted through a window in the platen of a rotating CMP tool and reflected back through the window to a detector is used to sense changes in a reflected optical signal. However, the window complicates the CMP process because it presents to the wafer an inhomogeneity in the polish pad. Such a region can also accumulate slurry and polish debris that can cause scratches and other defects.

Another approach is of the type disclosed in European application EP 0 824 995 A1, which uses a transparent window in the actual polish pad itself. A similar approach for rotational polishers is of the type disclosed in European application EP 0 738 561 A1, in which apad with an optical window is used for EPD. In both of these approaches, various means for implementing a transparent window in a pad are discussed, but making measurements without a window was not considered. The methods and apparatuses disclosed in these patents require sensors to indicate the presences of a wafer in the field of view. Furthermore, integration times for data acquisition are constrained to the amount of time the window in the pad is under the wafer.

In another type of approach, the carrier is positioned on the edge of the platen so as to expose a portion of the wafer. A fiber optic based apparatus is used to direct light at the surface of the wafer, and spectral reflectance methods are used to analyze the signal. The drawback of this approach is that the process must be interrupted in order to position the wafer in such a way as to allow the optical signal to be gathered. In so doing, with the wafer positioned over the edge of the platen, the wafer is subjected to edge effects associated with the edge of the polish pad going across the wafer while the remaining portion of the wafer is completely exposed. An example of this type of approach is described in PCT application WO 98/05066.

In another approach, the wafer is lifted off of the pad a small amount, and a light beam is directed between the wafer and the slurry-coated pad. The light beam is incident at a small angle so that multiple reflections occur. The irregular topography on the wafer causes scattering, but if sufficient polishing is done prior to raising the carrier, then the wafer surface will be essentially flat and there will be very little scattering due to the topography on the wafer. An example of this type of approach is disclosed in U.S. Pat. No. 5,413,941. The difficulty with this type of approach is that the normal process cycle must be interrupted to make the measurement.

A further approach entails monitoring absorption of particular wavelengths in the infrared spectrum of a beam incident upon the backside of a wafer being polished so that the beam passes through the wafer from the nonpolished side of the wafer. Changes in the absorption within narrow, well defined spectral windows correspond to changing thickness of specific types of films. This approach has the disadvantage that, as multiple metal layers are added to the wafer, the sensitivity of the signal decreases rapidly. One example of this type of approach is disclosed in U.S. Pat. No. 5,643,046.

SUMMARY

The invention provides a method and a tool for chemical mechanical polishing of thin films on a semiconductor wafer surface that predicts an endpoint of a polishing process. In general, the invention uses the fact that the reflectance spectrum from a wafer surface varies with the extent to which the surface is polished. At some point, there is a surface reflectance that approximates the desired endpoint of the polishing process.

In one embodiment, the method utilizes an apparatus that includes a polish pad having a through-hole, which is in optical communication with a light source through a fiber optic cable assembly. The apparatus also includes a light sensor, and a computer. The light source provides light within a predetermined bandwidth. The fiber optic cable propagates the light through the through-hole to illuminate the wafer surface during the polishing process. The light sensor receives reflected light from the surface through the fiber optic cable and generates data corresponding to the spectrum of the reflected light. The computer receives the reflected spectral data (the "reflected signal") and generates a signal as a function of the reflected spectrum (the "reflectance spectrum", i.e., a gathered reflectance spectrum). The generated signal is then compared to spectra taken from other similar wafers (the "reference spectrum") processed prior to the current wafer. The comparison involves using any of many available methods to generate a difference between the reflected signal and the reference signal to provide data points at each sample time that may, for ease of explanation, be graphically visualized as difference (y-axis) vs. time (x-axis). (The calculation may, of course, be done with other statistical analysis methods as well.) The computer then calculates a trigger time by first calculating the slope between the graphed comparison data points. Second, a best fit line is then fitted to the data points and is extrapolated to cross the time axis resulting in a time axis intercept, which is the trigger time. Third, a predetermined value ("difference time") is then added to the time intercept (trigger time) resulting in an endpoint time.

The predetermined value to be added to the trigger time allows a more accurate endpoint time to be achieved. One way to determine the value is to compare the reflectance data file with the reference data files throughout a large segment of the polishing process. For example, this comparison could entail systematically correlating the spectral data from the reflectance data file and the reference data file. The resultant data would represent the time difference with respect to the process completion at each data sample, that is, where in time ahead of or behind the reference wafer is the wafer currently being polished at each sampled point in time. In other words, the best correlation between a given reflectance spectrum and a set of reference spectra can be used to determine whether the current wafer is being polished faster or slower than the rate at which the reference wafer was polished.

Correlating a sequence of reflectance spectra sequentially to each of several reference spectra allows using the extrapolation technique described above to determine zero-crossing times for each of the several reference spectra, and in so doing generate a deviation signal that represents how much faster or slower a given wafer is polishing compared to the reference wafer. At the endpoint time, or at a time established as a known completion time if the endpoint time has not occurred, the polishing process is terminated.

Optical endpoint detection is accomplished by a comparison between a reference spectrum and the monitored reflectance spectrum. The reference spectrum is obtained by polishing a reference wafer to a process of record (POR) polish time and using the POR conditions while monitoring the reflectance spectra vs. time from the wafer. A reflectance spectrum from the entire time period is then assigned as the reference spectrum. One or more wafers may be used to establish the reference spectrum.

This Summary of the Invention section is intended to introduce the reader to aspects of the invention and is not a complete description of the invention. Particular aspects of the invention are pointed out in other sections herebelow and the invention is set forth in the appended claims, which alone demarcate its scope.

BRIEF DESCRIPTION OF THE DRAWINGS

The foregoing embodiments and many of the attendant advantages of this invention will become more readily appreciated by reference to the following detailed description, when taken in conjunction with the accompanying illustrative drawings that are not necessarily to scale, wherein.

DETAILED DESCRIPTION

Figure 1:
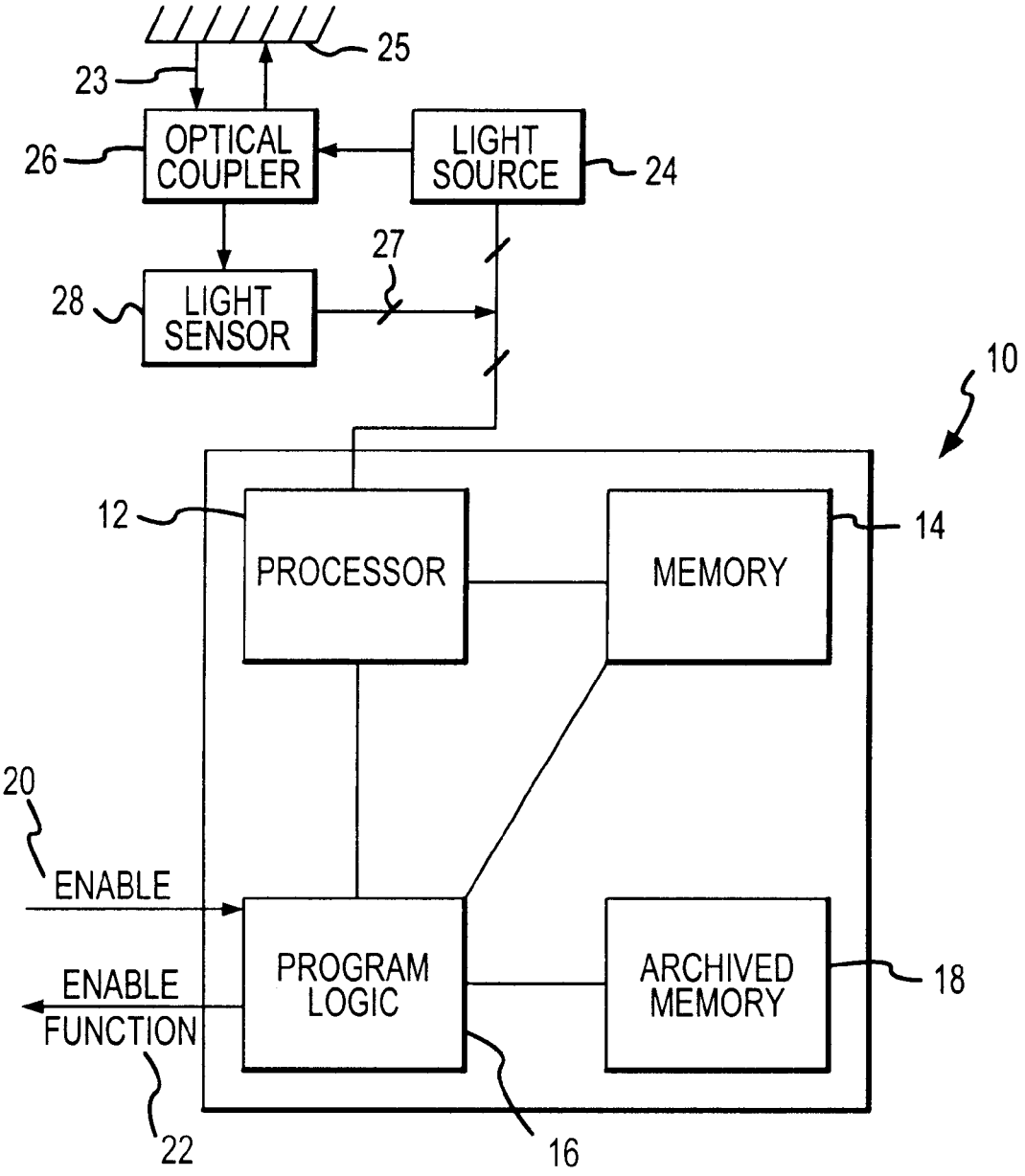
FIG. 1 is a schematic representation of one embodiment of the present invention.

The present invention relates to a method of optical endpoint detection (EPD) in chemical mechanical planarization (CMP), and specifically to a method of processing the optical data and predicting an endpoint time. The invention is an improvement over all known systems because it predicts a more precise endpoint even with sparse data. FIG. 1 illustrates one embodiment of the CMP endpoint predictive system 10 in accordance with the invention.

A processor 12 is in communication with program logic 16. Upon receipt of an enable signal 20, program logic 16 directs the processor 12, which is in communication with an incident light source 24 to propagate a waveform upon receiving an enable signal 20. The incident light source 24 is in communication with an optical coupler 26, which allows the waveform to advance to a surface 25. Surface 25 reflects reflected waveform 23 back to the optical coupler 26. There are several reflection processes used throughout the industry to propagate and collect reflection data and one embodiment is detailed in FIG. 5 herein below. The optical coupler 26 is in communication with a light sensor 28 and relays the reflected waveform 23 to the light sensor 28. The light sensor 28 operates to provide reflective spectral data 27 to the processor 12 in digital form. Processor 12 can be 5 implemented as a microprocessor, a programmable logic controller (PLC), or any other type of programmable logic device (PLD). Program logic 16 can be located in either volatile or non-volatile memory that may include but is not limited to random access memory (RAM), read only memory (ROM), programmable read only memory (PROM), erasable programmable read only memory (EPROM), or any other type of memory which would allow the program logic to function properly. The light sensor 28 can be of any type, which would produce a digital data spectrum based on optical input. Examples include, but are not limited to the S2000 and PC2000 from Ocean Optics located in El Dorado Hills, Calif.; the "F" series of products from Filmetrics Inc. of San Diego, Calif.; or the like.

The processor 12 is in communication with memory 14 and the program logic 16 directs the processor 12 to store the reflected spectral data in the memory 14. Memory 14 is in communication with program logic 16, which acquires the reflected spectral data from the memory 14. Program logic 16 is also in communication with archived memory 18, which contains reference spectral data from a electronic waveform also referred to as the "key file". Program logic 16 then acquires the reference spectral data from archived memory 18 and implements one or more algorithms to compare the spectral data of the reflected and reference waveforms. When predetermined conditions are met the program logic 16 generates the endpoint function 22.

The present invention provides a process for predicting an endpoint time. One embodiment of the present invention entails determining a trigger time and determining the amount of time (the "difference time") to be added to or subtracted from the trigger time resulting in a predicted endpoint time. The difference time represents either over polish or under polish and is generally attributable to pad wearing, variations in slurry flow, etc.

To determine a trigger time the program conducts a comparison, which may consist of any method to determine a "difference" between the reference signal and the reflectance signals during polishing. This comparison would generally only be conducted as one nears the expected endpoint of the polishing process, for the sake of simplicity, but may be implemented continually through the polishing process. One method might be to calculate, for example, the sum of the squares of the differences of the reflectance from the reference spectrum and the reflected spectrum using each point in the corresponding spectra (see EQUATION 1).

$$S(t)=\Sigma_i[R(\lambda_i, t)-R_{ref}(\lambda_i, t_{ref})]^2 \quad 1)$$

Figure 2:
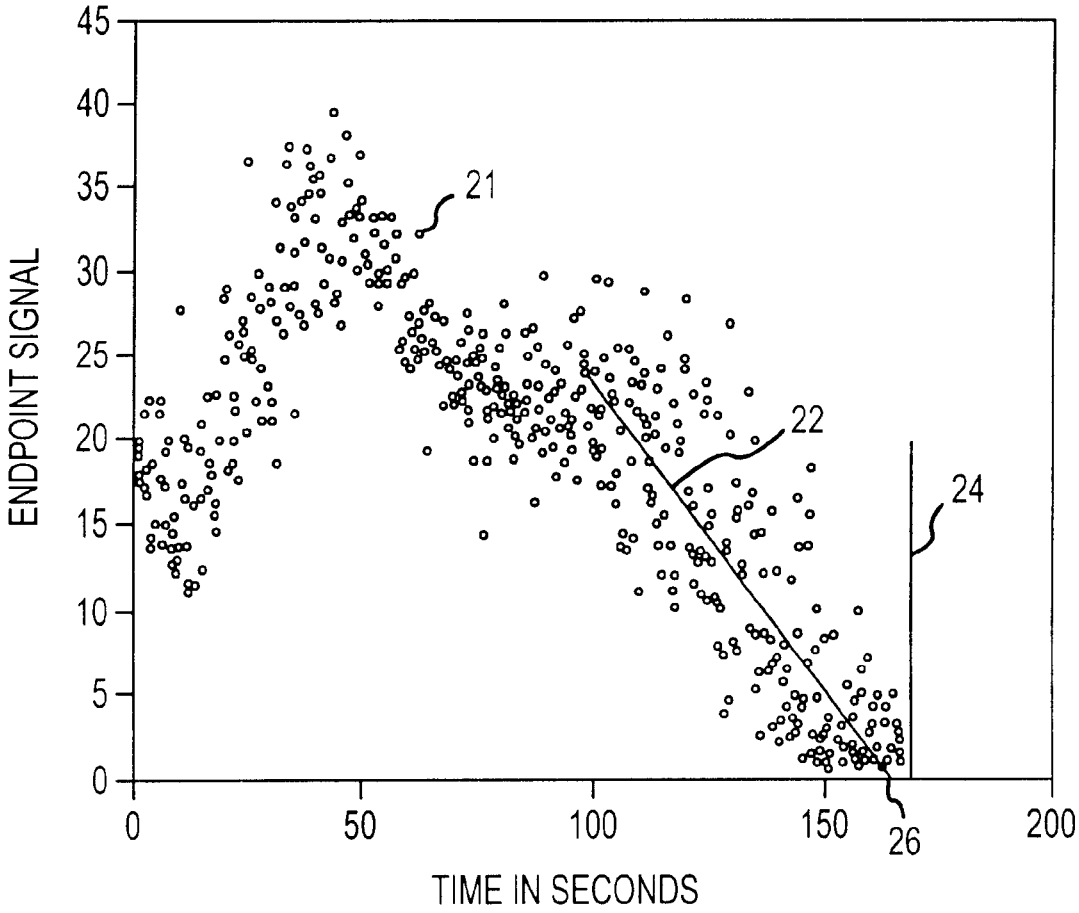
FIG. 2 is a graph of normalized sampled data versus polish time to project an "endpoint trigger time".

In the above equation S(t) is the end point signal as a function of polish time, $R(\lambda_i,t)$ is the measured reflectance spectrum at polish time t, and $R(\lambda_i,t_{ref})$ is the reference spectrum at the time $t_{ref}$. The end point signal data (y-axis) can be plotted against polish time (x-axis), as illustrated in FIG. 2 (an example), to show the convergence of the data. The program fits a subset of individual data points 21 in the endpoint signal to a straight line 22. The time corresponding to the x-intercept is then defined as the "endpoint trigger time" 26. An end time 24, based upon previously collected data or experience, may be used to provide a "fail-safe" end time. That is, in time to end the process to prevent overpolishing.

It should be noted that while FIG. 2 provides a visual illustration that a program may output to some type of output device (for example, a monitor), the computer can implement the program internally unto itself. FIG. 2 is provided for clarity and to assist one having skill in the art in utilizing this program or another program, using techniques such as, for example, regression analysis, analysis of variance (ANAVAR) or statistical curve fitting techniques, that would result in a similar outcome.

The invention includes methods for predicting the additional time ("difference time") to be added to or subtracted from the trigger time. One method utilizes data collected from the beginning of the polishing cycle until the trigger time program commences. This method also requires one patterned wafer to be designated a reference wafer and that it be polished to a fixed time to obtain a spectral data at intervals of time, each of which is stored as a separate file in the "key file". The key file is therefore that collection of spectral data files collected from the onset of the process until the last file, or close to the last file, of data is collected. For example, if the last data file of spectral reference data were collected from an undesirable point in time (i.e. a point in time where the wafer was over polished), a file near in time to the last file might be used in its place so long as the file used was created prior to the time where over polish of the wafer occurred.

As an unpolished wafer (with the same or very similar pattern) is polished, spectra sampled at time intervals are compared to spectra from the reference wafer. This process is shown schematically in FIG. 3 (polish time x-axis versus correlation magnitude y-axis) and illustrates a potential time differential or "shift," which may occur between the reference wafer and a wafer being polished.

Figure 3:
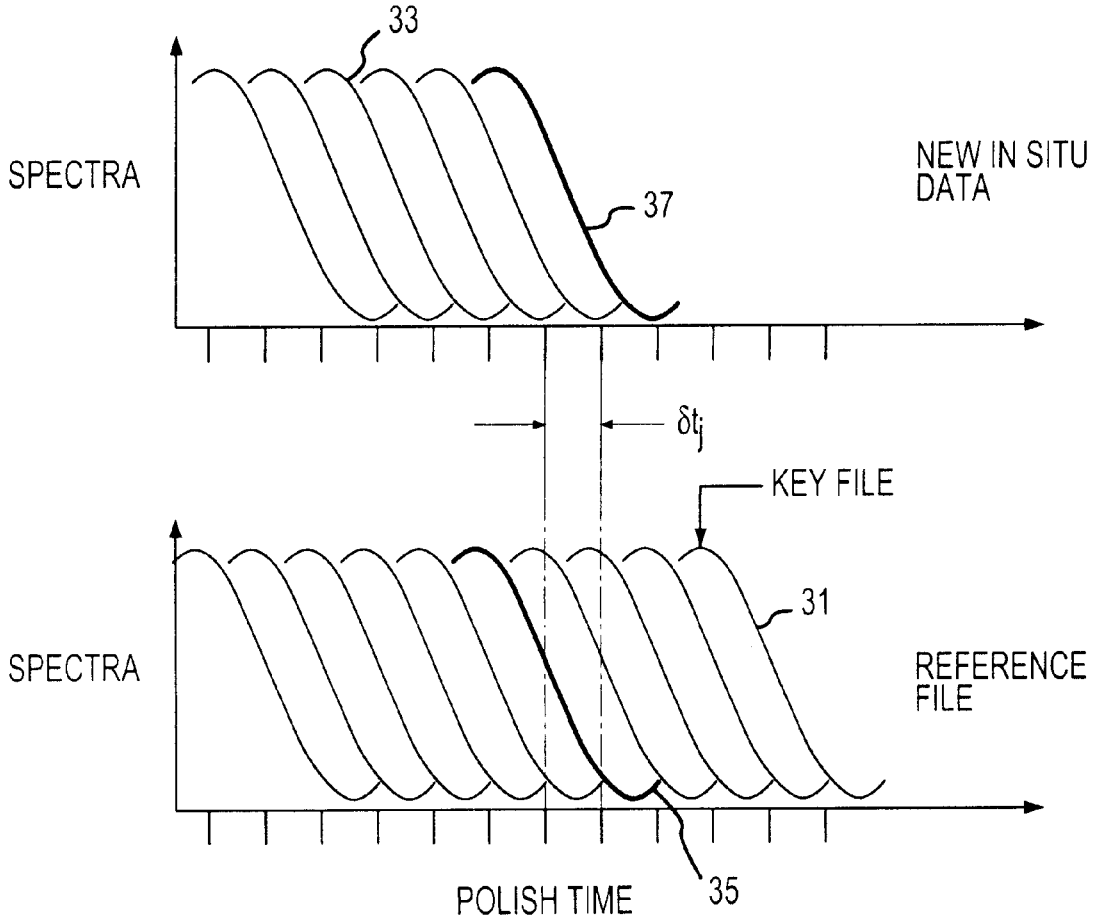
FIG. 3 is a schematic representation of the matching of freshly measured spectral data to spectral data from the reference wafer.

The data collected from the reference wafer, i.e., the key file data, can be graphically represented by plotting the reference correlation data 31 against time. Similarly, the data collected from the wafer undergoing the polishing process can be graphically represented by plotting the reflectance correlation data 33 over time. The invention addresses the problem of over polish/under polish by comparing each sample of wafer spectra of the wafer being polished (the "reflected spectra file") with a subset of the spectra samples in the key file (the "reference spectral file") of the reference wafer to find a closest match. It should be noted that while FIG. 3 provides a visual illustration that a program may output to some type of output device (for example, a monitor), the computer might implement the program internally unto itself. FIG. 3 is provided for clarity and to assist one having ordinary skill in the art in utilizing this program or another analysis method, such as, for example, a correlation function, that would result in a similar outcome.

One way to compare the sampled reflectance spectral files with the reference spectral files is to correlate the new reflectance spectral data file collected from the wafer surface at a point in time with the reference spectral data files. This comparison might be accomplished by comparing the new reflectance file with a first file in time of the key file, and then comparing the same new file with the second file in time of the key file, and continuing until all of the files of the key file have been compared to the new reflectance spectral data file. The comparison can be conducted, for example, using the method described above and given in EQUATION 1. Other methods of comparing spectral data could be used as well. The minimum value result determines the best fit. Best fit occurs when one sample from the wafer being polished and the reference wafer have a minimal difference between them and this represents a point where both wafers have been polished to approximately the same degree. The difference in time (or "time difference") from where this occurs on the reference wafer 35 and the polishing wafer 37 is denoted as $\delta t_j$. A comparison of the time difference within a polishing process for any given wafer to any other wafer allows a comparison of the CMP performance from wafer to wafer. Differences from wafer to wafer could indicate, for example, variations in slurry flow, pad wear, etc. One way to calculate this relationship is through the use of correlation theorem, of which an example is provided in EQUATION 2 below.

$$x_j=\min\{\Sigma_i(\text{NewSpectra}_{i,j}-\text{OldSpectra}_{i,j})^2\} \quad 2)$$

In the above equation $x_j$ is the correlation value for the jth spectra, i is the wavelength index, and j is the time index. This function will have a minimum value at the time of the best fit. An alternative method is to use a correlation function. This approach gives the optimum value when the correlation function reaches a maximum. That maximum should be close to, but usually less than, one.

Figure 4:
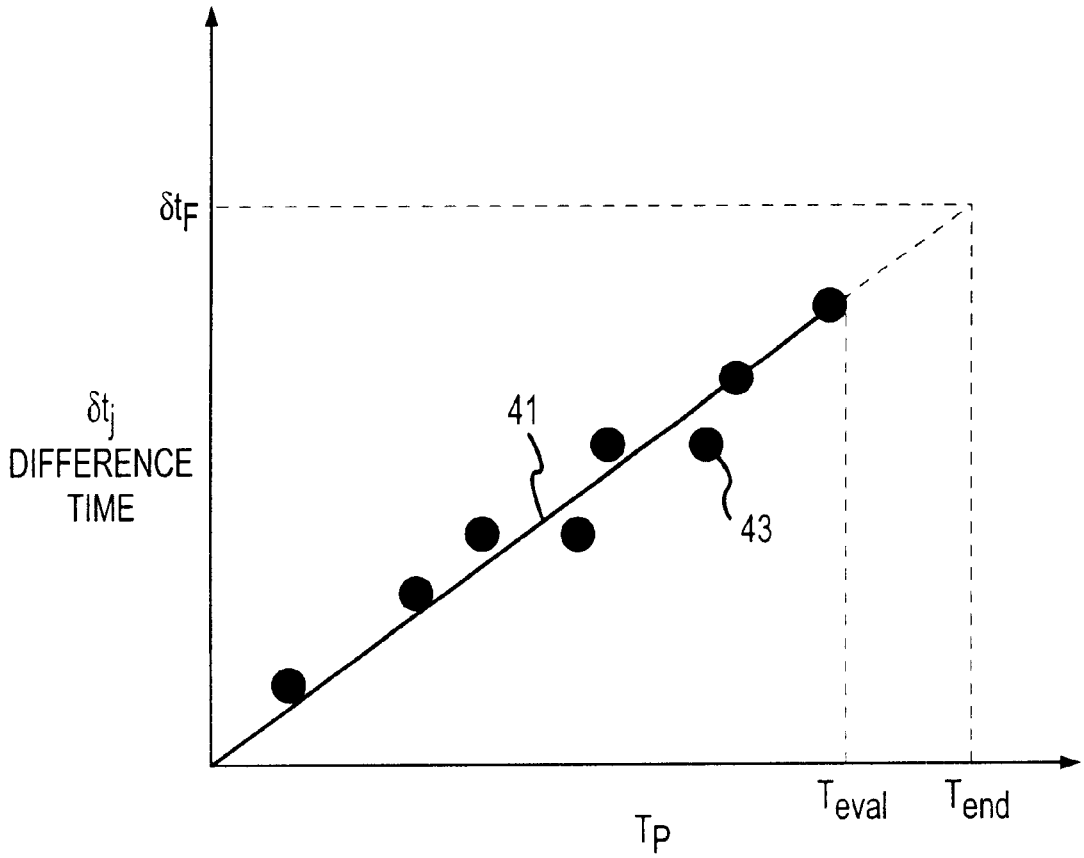
FIG. 4 is a graph of correlated sampled data versus polish time to project a "difference time".

The "difference time" to be added to the trigger time, in a preferred embodiment, might be determined by plotting reflectance correlation data 43 as the time difference ("time shift," $\delta t_j$) (y-axis) against polish time (x-axis), as illustrated in FIG. 4 (an example). The algorithm might use the individual data points from reflectance correlation data 43 and fit them to a best fit line 41. Extrapolating the line 41 fitted to the time difference ($\delta t_j$) data collected with respect to time will achieve an intercept at a given time. The intercept of the fitted line 41 with the endpoint time $T_{end}$ established from the reference wafer is then defined as the "difference time". It should be noted that while FIG. 4 provides a visual illustration that a program may output to some type of output device (for example, a monitor), the computer might implement the program internally unto itself. FIG. 4 is provided for clarity and to assist one having skill in the art in utilizing this program or another program, using techniques such as, for example, regression analysis, analysis of variance (ANAVAR) or statistical curve fitting techniques, that would result in a similar outcome. $T_{eval}$, in this embodiment, represents the trigger time. $T_{end}$ represents the endpoint time achieved by the reference wafer. The amount of time ($\delta t_F$) to be added to or subtracted from the trigger time is determined by the value of the time difference ($\delta t_j$) when the line crosses $T_{end}$.

Although $T_{eval}$ (the "evaluation time") in the preferred embodiment above can be the trigger time, it could also be determined in any of several other ways. For instance, a time could be picked arbitrarily, for example 20 seconds prior to the end of the reference polish time as $T_{eval}$. It is important to determine a $T_{eval}$ that allows so that $T_{end}$ will not be exceeded. In another embodiment, a third key file is used to determine the evaluation time ($T_{eval}$), that is, when to apply the difference time. Yet another embodiment would be to use an exponentially weighted average of the data to place more emphasis on more recently gathered data.

Alternatively, the corrected endpoint time could be calculated continuously, utilizing EQUATION 3, until the following criteria were satisfied.

$$t-(T_F+\delta t)\leqq\epsilon \qquad 3)$$

In the above equation t is the current polish time, $\delta t$ is the current predicted adjustment time, $T_F$ is the final time or end time, and $\epsilon$ is the sampling period. The equation describes a constraint on process instantaneous time t relative to process of record time T and the expected deviation in the process time $\delta t$ as determined by the method and apparatus of the present invention. In one embodiment $T_F$ may be two minutes, $\delta t$ may be any where from −20s–20s (depending on the polishing pad used), and $\epsilon$ may be one to four times per second.

While these methods are effective at predicting an endpoint time, a preferred embodiment described above presents a potentially more useful and less challenging approach to implement the present invention and is further detailed in FIG. 5 below. In one actual embodiment the trigger time approach is utilized as a fail-safe to ensure wafers are not over polished, resulting in product loss.

Under some circumstances, e.g. the presence of gaseous bubbles in the slurry, noise in the system may present challenges in the data collection process. Additional signal conditioning may be used to reduce the noise of the system. Such conditioning includes smoothing the spectra in wavelength or energy and smoothing the endpoint signal over time. In one implementation, the program logic 16 requires that any comparison test be valid for n-times sequentially before end-point is declared, where n is user selectable, e.g. 5. Another technique is to normalize the total integrated measured spectrum to a standard value and the reference spectrum to the same value before calculation of the endpoint takes place.

In one embodiment, the invention is utilized with a system in which there is about 1 mm of slurry between the tip of an optical probe and the wafer surface. In a copending patent application U.S. patent application Ser. No. 09/307,995, an invention was described in which a pH adjusted fluid is pumped into the region about the probe, and is hereby incorporated by reference to the extent pertinent. Doing so clears the slurry from between the probe and the surface of the wafer. The absence of slurry significantly reduces the noise present in the signal and enables more sophisticated data analysis techniques. Use of this system, though not essential to the present invention, significantly improves the quality of the data that is collected.

Additionally, the calculation that determines the difference between the reference spectrum and the measured spectra may be formulated in other ways. For example, the exponent may in EQUATION 1 can be a different power instead of 2, the measured spectrum may be divided by the reference spectrum and squared or left as a signed vector, or a moment in spectrum space may be calculated for each reference spectrum and measured spectrum and the moments subtracted. Again, one having ordinary skill in the art can use these or other acceptable methods for calculating the differences between the spectra.

In operation of the preferred embodiment, for example using a shallow trench isolation (STI) type of patterned wafer, the system might begin to collect data from the start of the process. In one embodiment, beginning at approximately 88% of expected endpoint time until approximately 94% of expected endpoint time, the line fit slope and y-axis intercept recorded data are collected and then averaged utilizing the method of EQUATION 1 or one of the other methods described above. The resulting data is then used to fit a line to the data (referring to FIG. 2). The time-axis (x-axis) intercept is then defined as the LineFit trigger (or trigger time). Spectral reflectance data collected prior to the point of collecting data for the LineFit trigger is correlated (referring to FIG. 3) with the key file data at commencement of the data collection process utilizing methods described above. The resulting data is then used to fit a line to the data (referring to FIG. 4) to determine the amount of time ($\delta t_F$) to add to or subtract from the LineFit trigger time. Upon determination of a LineFit trigger time the value $\delta t_F$ is then added to or subtracted from the LineFit trigger time to represent over polish or under polish time. The resultant time is then established as the endpoint time and applied to the polishing process for the immediate wafer.

The present invention allows one to use a single procedure to predict endpoint for a variety of CMP applications. This method works on a broader range of wafers than previously disclosed methods including STI, tungsten metal layer (W), copper metal layer (Cu), and inter layer dielectric (ILD) type wafers and in practice this method can be used for process quality checks. This method is less susceptible to noise than other methods and it is more immune to sparse data and signal drift. This endpoint detection method also provides for correction and compensation of the endpoint trigger for drifts in the baseline of the endpoint signal.

The present invention may be practiced with any optical data collection system on any type of polisher, such as rotary, orbital, linear, or other motion CMP systems. An example of a preferred data collection system is illustrated in FIG. 5 below. In addition, it may be practiced with any optical system that returns a reflectance measurement at more than one wavelength. While two wavelengths would work, typical broadband illumination and detection is preferred. Such illumination between 200 nm and 1000 nm would suffice, with 400 nm to 850 nm being preferred. This method will work with all known semiconductor wafer films and filmstacks. Clearing of metal layers and the thinning and planarization of transparent film stacks on both sheet film and patterned wafers is possible with the present invention.

The present invention can be used in a wide variety of CMP tools, including but not limited to orbital polishers. For example, U.S. Pat. No. 6,106,662 entitled "Method and Apparatus for Endpoint Detection for Chemical Mechanical Polishing," discloses an orbital chemical-mechanical polishing apparatus, and is hereby incorporated by reference to the extent pertinent.

Figure 5:
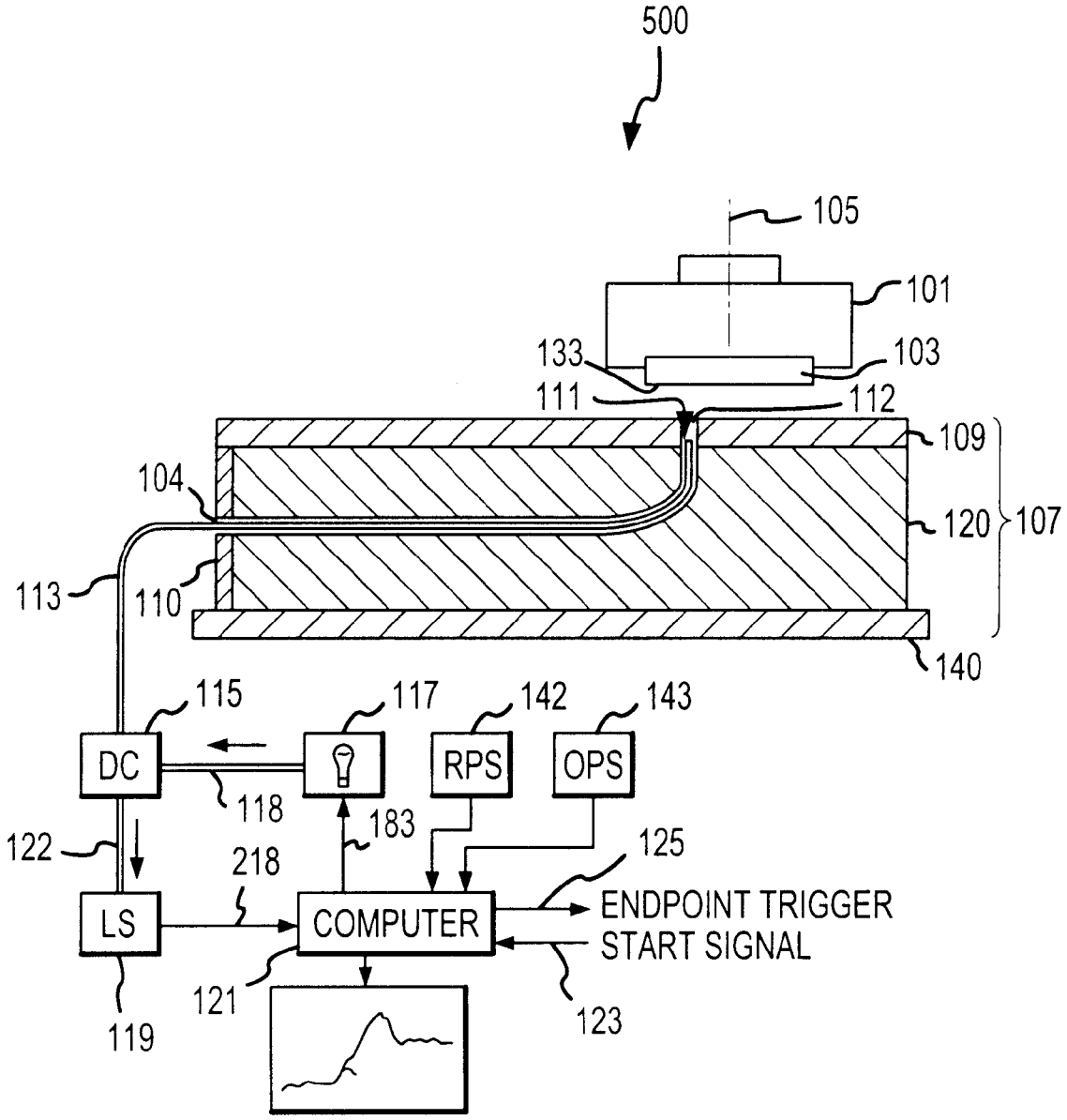
FIG. 5 is a schematic representation of a preferred embodiment of the present invention.

This type of CMP apparatus is shown in FIG. 5 and is a preferred embodiment for collecting data to implement the present invention. CMP machines typically include a structure for holding a wafer or substrate to be polished. Such a holding structure is sometimes referred to as a carrier, but the holding structure of the present invention is referred to herein as a "wafer chuck". CMP machines also typically include a polishing pad and a way to support the pad. Such pad support is sometimes referred to as a polishing table or platen, but the pad support of the present invention is referred to herein as a "pad backer". Slurry is required for polishing and is delivered either directly to the surface of the pad or through-holes and grooves in the pad directly to the surface of the wafer. The control system on the CMP machine causes the surface of the wafer to be pressed against the pad surface with a prescribed amount of force. The motion of the wafer relative to the pad depends on the type of machine.

Further, as described below, the motion of the polishing pad is non-rotational in one embodiment to enable a short length of fiber optic cable to be inserted into the pad without need for an optical rotational coupler. Instead of being rotational, the motion of the pad is "orbital" in a preferred embodiment. In other words, each point on the pad undergoes circular motion about its individual axis, which is parallel to the wafer chuck's axis. In one embodiment, the orbit diameter is 1.25 inches although other diameters are also useful. Further, it is to be understood that other elements of the CMP tool not specifically shown or described may take various forms known to person of ordinary skill in the art. For example, the present invention can be adapted for use in the CMP tool disclosed in the U.S. Pat. No. 5,554,064, which is incorporated herein by reference to the extent relevant.

A schematic representation of an embodiment of an overall system 500 of data collection for the present invention is shown in FIG. 5. As seen, a wafer chuck 101 holds a wafer 103 having a surface 133 that is to be polished. The wafer chuck 101 preferably rotates about its vertical axis 105. A pad assembly 107 includes a polishing pad 109 mounted onto a pad backer 120. The pad backer 120 is in turn mounted onto a pad backing plate 140. In one embodiment, the pad backer 120 is manufactured from urethane and the pad backing plate 140 is stainless steel. Other embodiments may use other suitable materials for the pad backer and pad backing. Further, the pad backing plate 140 is secured to a driver or motor means (not shown) that is operative to move the pad assembly 107 in the preferred orbital motion.

Polishing pad 109 includes a through-hole 112 that registers with a pinhole opening 111 in the pad backer 120. Further, a canal 104 is formed in the side of pad backer 120 adjacent to the backing plate. The canal 104 leads from the exterior side 110 of the pad backer 120 to the pinhole opening 111. In one embodiment, a fiber optic cable assembly including a fiber optic cable 113 is inserted in the pad backer 120 of pad assembly 107, with one end of fiber optic cable 113 extending through the top surface of pad backer 120 and partially into through-hold 112. Fiber optic cable 113 can be embedded in pad backer 120 so as to form a watertight seal with the pad backer 120, but a watertight seal is not necessary to practice the invention. Further, in contrast to conventional systems as exemplified by Lustig et al. that use a platen with a window of quartz or urethane, the present data collection technique does not include such a window. Rather, the pinhole opening 111 is merely an orifice in the pad backer in which fiber optic cable 113 may be placed. Thus, in the present invention, the fiber optic cable 113 is not sealed to the pad backer 120. Moreover, because of the use of a pinhole opening 111, the fiber optic cable 113 may even be placed within one of the existing holes in the pad backer and polishing pad used for the delivery of slurry without adversely affecting the CMP process. As an additional difference, the polishing pad 109 has a simple through-hole 112.

Fiber optic cable 113 leads from through-hole 112 to an optical coupler 115 that receives light from a light source 117 via a fiber optic cable 118 and directs light from the light source 117 to the surface 133 of wafer 103. The optical coupler 115 also propagates a reflected light signal to a light sensor 119 via fiber optic cable 122. The reflected light signal is generated in accordance with the present invention, as described below.

A computer 121 provides a control signal 183 to light source 117 that directs the emission of light from the light source 117. The light source 117 is a broadband light source, preferably with a spectrum of light between 200 and 1000 nm in wavelength, and more preferably with a spectrum of light between 400 and 900 nm in wavelength. A tungsten bulb is suitable for use as the light source 117. Computer 121 also receives a start signal 123 that activates the light source 117 and the EPD methodology. The computer 121 also provides an endpoint trigger 125 when, through the analysis of the present invention, it is determined that the endpoint of the polishing has been reached.

Orbital position sensor 143 provides the orbital position of the pad assembly while the wafer chuck's rotary position sensor 142 provides the angular position of the wafer chuck to the computer 121, respectively. Computer 121 can synchronize the trigger of the data collection to the positional information from the sensors. The orbital sensor identifies which radius the data is coming from and the combination of the orbital sensor and the rotary sensor determine which point.

In operation, soon after the CMP process has begun, the start signal 123 is provided to the computer 121 to initiate the monitoring process. Computer 121 then directs light source 117 to transmit light from light source 117 via fiber optic cable 118 to optical coupler 115. This light in turn is routed through fiber optic cable 113 to be incident on the surface of the wafer 103 through pinhole opening 111 and the through-hole 112 in the polishing pad 109.

Reflected light from the surface 133 of the wafer 103 is captured by the fiber optic cable 113 and routed back to the optical coupler 115. Although in one embodiment the reflected light is relayed using the fiber optic cable 113, it will be appreciated that a separate dedicated fiber optic cable (not shown) may be used to collect the reflected light. The return fiber optic cable would then preferably share the canal 104 with the fiber optic cable 113 in a single fiber optic cable assembly.

The optical coupler 115 relays this reflected light signal through fiber optic cable 122 to light sensor 119. Light sensor 119 is operative to provide reflected spectral data of the reflected light to computer 121. The computer 121 depicted in FIG. 5 is detailed and its function described in the FIG. 1 above.

One advantage provided by the optical coupler 115 is that rapid replacement of the pad assembly 107 is possible while retaining the capability of endpoint detection on subsequent wafers. Additionally, positioning coupler relatively near the pad backer, as opposed to being near the light sensor and/or other equipment, facilitates the ease of operation of the system. In other words, the fiber optic cable 113 may simply be detached from the optical coupler 115 and a new pad assembly 107 may be installed (complete with a new fiber optic cable 113). For example, this feature is advantageously utilized in replacing used polishing pads in the polisher. A spare pad backer assembly having a fresh polishing pad is used to replace the pad backer assembly in the polisher. The used polishing pad from the removed pad backer assembly is then replaced with a fresh polishing pad for subsequent use.

After a specified or predetermined integration time by the light sensor 119, the reflected spectral data 218 is read out of the detector array and transmitted to the computer 121. The integration time typically ranges from 5 to 150 ms, with the integration time being 15 ms in a preferred embodiment. The computer 121 is then directed to practice the invention as is detailed above in the FIGS. 1 and 2 discussions.

In the preceding description and discussion the term wafer is meant to include all workpieces that are related to electronics, such as bare wafers with films, wafers partially or fully processed for forming integrated circuits and interconnecting lines, wafers partially or fully processes for forming micro-electro-mechanical devices (MEMS), specialized circuit assembly substrates, circuit boards, hybrid circuits, hard disk platters, flat panel display substrates, or other structures that would benefit from CMP with end point detection. Additionally, in the preceding description and discussion the term surface of a wafer include but is not limited to films including a metallic layer such as aluminum, copper, tungsten, and the like, an insulating layer such as glass, ceramics, and the like, or any other material layer which is commonly used in semiconductor processing and may benefit from this process.

The foregoing description provides an enabling disclosure of the invention, which is not limited by the description but only by the scope of the appended claims. All those other aspects of the invention that will become apparent to a person of skill in the art, who has read the foregoing, are within the scope of the invention and of the claims herebelow.

We claim:

1. A method for determining an endpoint during polishing of a semiconductor wafer, the method comprising:

sampling a reference wafer surface at time intervals to determine reference spectra at each time interval;

sampling a production wafer surface at time intervals to determine reflectance spectra at each time interval;

calculating an evaluation time based upon analysis of the spectra sampled;

calculating a difference time based upon analysis of the spectra sampled; and predicting a wafer polishing endpoint time based on the evaluation time and the difference time.

2. The method of claim 1, wherein the step of calculating the evaluation time comprises:

calculating a magnitude of a difference between the reflectance spectrum and the reference spectrum for each sampled time interval;

using paired data comprising calculated magnitudes and corresponding time intervals to determine a best straight line curve fit; and determining an evaluation time value when the magnitude difference is zero, based on the best curve fit.

3. The method of claim 1, wherein the step of calculating the difference time comprises:

comparing a reflectance spectrum sampled at a specific time with a file of reference spectra correlated with time to determine a difference time shift between a closest match of spectra;

analyzing differences between closest matching spectra; and determining the time difference based on the analysis of the differences.

4. The method of claim 1, wherein the step of predicting the endpoint time comprises:

calculating a sum of the evaluation time and the difference time.

5. The method of claim 1, wherein the step of sampling a production wafer is performed throughout the entire polishing process.

6. An apparatus to generate an endpoint during polishing of films on a semiconductor wafer for use in a chemical mechanical polishing system comprising:

a light source providing light to reflect from a film;

a light sensor receiving a spectrum of light reflected from the film, the light sensor including a processor generating, in digital form, spectral reflective data based on the reflected spectrum of light; and a computer in communication with the light sensor and programmed to generate an endpoint calculated from the spectral reflectance data, wherein the generation of the endpoint comprises:

calculating an evaluation time based upon data collected;

calculating a difference time based upon data collected; and predicting the wafer polishing endpoint time based on the evaluation time and the difference time.

7. The apparatus of claim 6, wherein the computer is programmed to calculate the evaluation time through steps comprising:

sampling the wafer surface at time intervals to determine reference spectra at each time interval;

sampling the wafer surface at time intervals to determine reflectance spectra at each time interval;

calculating a magnitude of a difference between a reflectance spectrum and a reference spectrum for each sampled time interval;

using paired data comprising calculated magnitudes and corresponding time intervals to determine a best straight line curve fit; and determining an evaluation time value corresponding to when the magnitude difference is zero, based on the best curve fit.

8. The apparatus of claim 6, wherein the computer is programmed to calculate the difference time through steps comprising:

comparing a reflectance spectrum sampled at a specific time with a file of a reference spectra correlated with time to determine a time difference shift between the closest matching spectra;

analyzing differences between closest matching spectra; and determining the time difference based on the analysis of the differences.

9. The apparatus of claim 6, wherein the computer is programmed to predict the endpoint time through steps comprising:

calculating a sum of the evaluation time and the difference time.

10. The apparatus of claim 6, wherein the data collected is collected throughout the entire polishing process.

11. A method for detecting an endpoint during chemical mechanical polishing of a wafer surface of a wafer, the method comprising:

producing reference spectrum data corresponding to a spectrum of light reflected from the surface of a reference wafer during polishing;

producing reflectance spectrum data corresponding to a spectrum of light reflected from the surface of a production wafer during polishing;

comparing the reflected spectrum data with the reference spectrum data;

calculating an evaluation time based upon data collected;

calculating a difference time based upon the data collection; and predicting the endpoint time with the evaluation time and the difference time.

12. The method of claim 11, wherein the comparing step comprises calculating the sum of the square of the differences between the reflected spectrum data and the reference spectrum data at each sampled time interval.

13. The method of claim 11, wherein the step of calculating the evaluation time comprises:

using paired data comprising calculated magnitudes and corresponding time intervals to determine a best straight line curve fit; and determining an evaluation time value when the magnitude difference is zero, based on the best curve fit.

14. The method of claim 11, wherein the step of calculating the difference time comprises:

comparing a reflectance spectrum sampled at a specific time with a file of a reference spectra correlated with time to determine a time difference shift between the closest matching spectra;

analyzing differences between closest matching spectra; and determining the time difference based on the analysis of the differences.

15. The method of claim 11, wherein the step of predicting the endpoint time comprises:

calculating the sum of the evaluation time and the difference time.

16. The method of claim 11, wherein the steps of collecting data samples are preformed throughout the entire polishing process.

* * * * *